United States Patent [19]

Huggins

[11] Patent Number: 4,677,704

[45] Date of Patent: Jul. 7, 1987

[54] CLEANING SYSTEM FOR STATIC CHARGED SEMICONDUCTOR WAFER SURFACE

[76] Inventor: Richard A. Huggins, 19866 Beekman Pl., Cupertino, Calif. 95014

[21] Appl. No.: 854,481

[22] Filed: Apr. 22, 1986

[51] Int. Cl.[4] ..... A47L 5/14

[52] U.S. Cl. ..... 15/1.5 R; 15/306 R; 15/316 R; 15/404

[58] Field of Search ..... 15/306 R, 306 A, 306 B, 15/308, 1.5, 316 R, 345, 346, 404

[56] References Cited

U.S. PATENT DOCUMENTS

| | | | |
|---|---|---|---|
| 3,668,008 | 6/1972 | Severynse | 15/306 A X |
| 3,939,526 | 2/1976 | Mania et al. | 15/306 B |
| 4,198,061 | 4/1980 | Dunn | 15/306 R X |
| 4,268,934 | 5/1981 | Testone | 15/306 B |
| 4,364,147 | 12/1982 | Biedermann et al. | 15/316 R X |
| 4,454,621 | 6/1984 | Testone | 15/306 A X |
| 4,461,651 | 7/1984 | Hall | 15/316 R X |

*Primary Examiner*—Chris K. Moore

*Attorney, Agent, or Firm*—Flehr, Hohbach, Test, Albritton & Herbert

[57] ABSTRACT

A system for removing extremely fine specks of contaminants from a surface by means of applying air-borne vibrations to the speck coincident with creation of a neutral static charge acting on the speck.

6 Claims, 5 Drawing Figures

CLEANING SYSTEM FOR STATIC CHARGED SEMICONDUCTOR WAFER SURFACE

This invention pertains to a system for removing specks of dust or other small particulate matter from an electrostatically charged surface and is particularly useful in removing extremely small specks of dust from semiconductor wafer material.

BACKGROUND OF THE INVENTION

A significant problem in the semiconductor industry is the removal of specks of matter from the surface of a semiconductor wafer. Presently, matter of the order of 0.5 to 0.3 microns has been found sufficient to contaminate a chip. As the industry continues to produce ever more intricate products, it is expected that 0.1 micron size specks will become a problem.

Silicon wafers take on an electrostatic charge as they are processed so as to make removal of specks of matter on the surface of a wafer much more difficult. One approach to the problem has been to attempt to remove the electrostatic charge by ionization of the wafer surface accompanied by directing a stream of clean air against the wafer surface so as to attempt to blow the specks of matter away.

It has been found that in the region approximately 0.04 to 0.004 inch above the zero surface, a laminar flow of air exists which is fairly ineffective in brushing the specks from the surface. Accordingly, this thin laminar layer passes in protective spaced relation across the smaller specks.

Accordingly, there has been a need for providing improved means for removing extremely fine specks of matter from an electrostatically chargeable surface.

SUMMARY OF THE INVENTION AND OBJECTS

In general, extremely fine specks of matter of the order of 0.5 microns and below, capable of contaminating a semiconductor surface, can be removed by means of a system including means for generating positive and negative ions to flow toward the surface in a manner serving to alternately charge the surface positive and negative while providing a neutral charge to the surface at the transition between positive and negative. In addition means for generating waves of gas-borne vibrations directed toward the surface serves to dislodge the specks from the surface when the surface has substantially the least attraction for the specks.

In general, it is an object of the present invention to provide a cleaning system for static charged semiconductor wafer surfaces capable of removing extremely small particulate matter therefrom.

It is another object of the present invention to provide such a system characterized by means for directing gas-borne vibrations against such a surface to penetrate a protective laminar flow of air thereacross.

Yet another object of the invention is to provide a system of the kind described in which gas-borne vibrations arrive at the zero surface contemporaneously with existence of a neutral static charge on such surface.

The foregoing and other objects of the invention will become more readily evident from the following detailed description of preferred embodiments when considered in conjunction with the drawings.

DETAILED DESCRIPTION OF PREFERRED EMBODIMENTS

Figure 1:
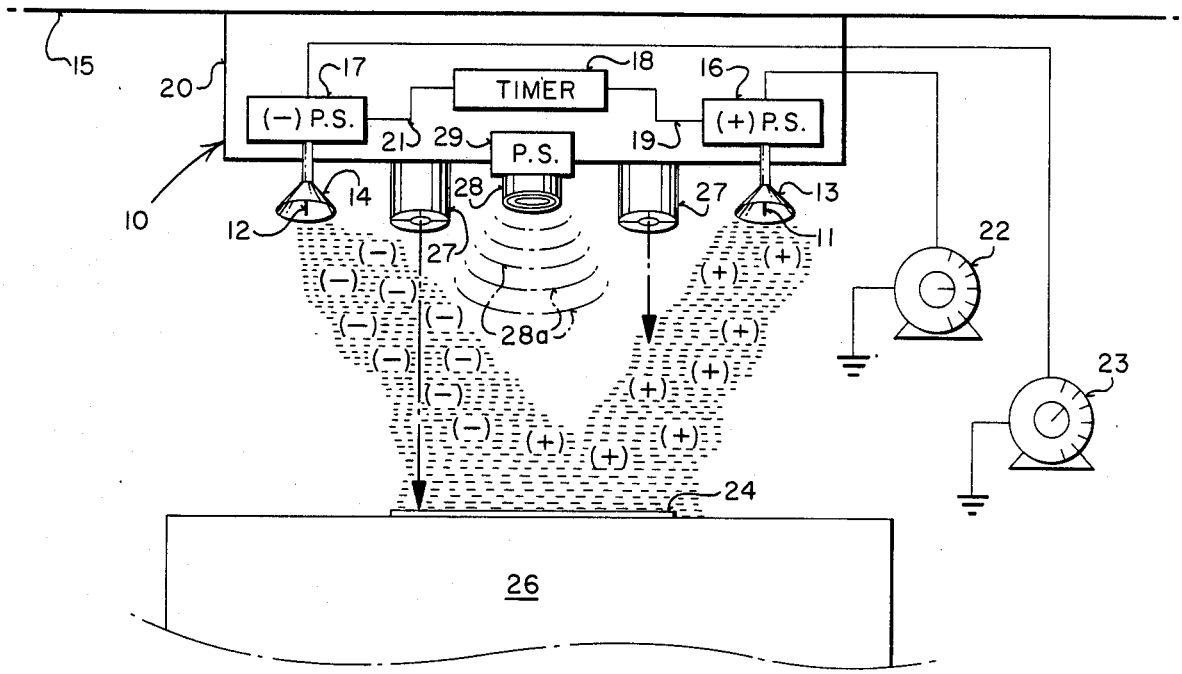
FIG. 1 shows a diagrammatic view of a system for cleaning semiconductor wafers according to the invention.

A system 10 within a housing 20 carried from a support 15 includes a pair of ion discharge devices 11, 12 characterized by an elongate needle disposed centrally within a protective conical plastic shield 13, 14 respectively. Positive and negative DC power supplies 16, 17 operate ion discharge devices 11, 12 respectively. Accordingly, when positive power supply 16 is coupled to ion discharge device 11, positive ions are generated therefrom. Similarly, when negative power supply 17 is coupled to ion discharge device 12, negative ions are generated.

Suitable timing means 18 connected by leads 19, 21 to power supplies 16, 17 respectively serves to alternately activate the power supplies whereby the surface of a workpiece 24 such as a semiconductor wafer will alternately acquire a positive or negative static charge. Potentiometers 22, 23 supply appropriate voltages to power supplies 16, 17.

A suitable stand 26 generally supports a workpiece 24, such as a semiconductor wafer to be cleaned. Ions from devices 11, 12, travel toward the surface of wafer 24.

By directing positive and negative ions toward the surface of workpiece 24, the static charge on the surface can vary between positive and negatives states. As the charge on workpiece 24 changes from a positive to a negative state or from a negative to a positive state, the electrostatic attraction to particles on workpiece 24 will be at a minimum. In short, by neutralizing the charge on workpiece 24, small particles of matter can be more easily blown therefrom by means of blowers 27, each coupled to a supply of clean air (not shown).

However, as noted above, when particle sizes become smaller than something of the order of 0.5 microns, removal of specks by such means becomes significantly more difficult.

As noted above, a portion of the stream of air directed against workpiece 24 provides a laminar flow across the surface of workpiece 24. This laminar flow portion of the stream of gas passes in protective spaced relation across the finest specks whereby blowers 27 become significantly less effective with respect to such fine particulate matter carried on the surface of workpiece 24. While blowers 27 supply clean air as disclosed, other gases can be used.

Means for disturbing the laminar flow of gas permits the specks of matter to be entrained in and carried away from the surface of workpiece 24 by the stream of air from blowers 27. Accordingly, suitable means for generating sonic or ultrasonic waves (i.e., air-borne vibrations) to flow toward the surface of workpiece 24 suitably disturb the laminar flow and vibrate the specks of matter on the surface of workpiece 24. As shown in FIG. 1, means serving to generate waves 28*a* of gas-borne vibrations directed toward the surface of workpiece 24 includes an ultrasonic or sonic generator 28 coupled to its associated power supply 29. The sonic or ultrasonic generator 28 may be of conventional construction preferably operable at frequencies on the order of 30, 40, 200, or 300 kHz.

Timer 18 preferably alternates between activation of positive power supply 16 and negative power supply 17 at a much lower frequency, for example, up to a frequency of the order of 100 Hz and down to a frequency on the order of 20 Hz. Accordingly, the frequency of the air-borne vibrations represented by waves 28*a* is significantly greater than the frequency of alternation between positive and negative ion generation.

By alternating positive and negative ions at a frequency substantially different from the frequency of the gas-borne vibrations represented by ultrasonic waves 28*a*, some of the waves 28*a* strike the laminar flow of gas protected specks of matter on surface 24 at a time when the surface charge is substantially neutralized. For example, with ion alternation at a frequency of 100 Hz and the frequency of the airborne vibrations being 30 kHz, the frequency of waves 28*a* or vibrations will be 300 times greater than the frequency of ion alternation. Such a large frequency differential insures that vibrations from waves 28*a* will strike the surface of workpiece 24 when its electrostatic attraction for the specks is at a minimum.

In short, the waves 28*a* attack the surface of workpiece 24 when its static charge is in transition, i.e., at that point in time when the surface has lost its charge of one polarity and before becoming substantially charged with an opposite polarity. Accordingly, as shown by way of illustration in FIG. 2, the wave form 31 represents the relatively slow rate of alternately activating ion discharge devices 11, 12 and correspondingly represents the rate at which the surface of workpiece 24 will alternate between a positive and negative state. By alternately providing positive and negative ions, the surface of workpiece 24 will carry a substantially neutral charge substantially at the transition points 32 as the charge on the workpiece changes between states.

Wave form 33 represents the frequency of the ultrasonic or sonic transmitter 28. Since the airborne vibrations represented by waves 28*a* flowing toward the surface of workpiece 24 have a significantly greater frequency than the frequency of alternation between ion discharge devices 11, 12, gas borne vibrations created by transmitter 28 will act to dislodge the specks when the charge on the surface of workpiece 24 has been substantially neutralized. At that point the surface will have the least electrostatic attraction for retaining the specks whereby they can be entrained in the flow of clean air from blowers 27. In addition, waves 28*a* will have disrupted the protective laminar flow of air across the specks so as to cause the specks to be carried away.

Figure 2:
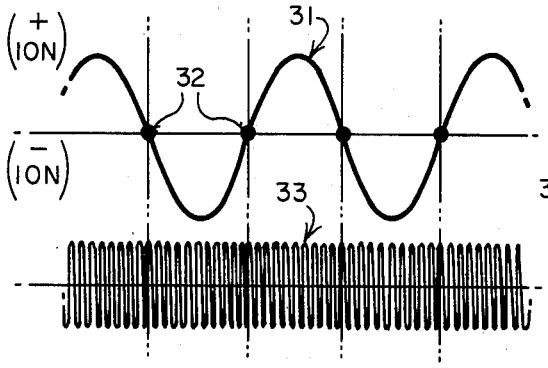
FIG. 2 shows a pair of waveforms disposed in relation to one another for purposes of explanation.

As shown in FIG. 2, for example, phantom lines 34 have been drawn to interconnect transition points 32 with wave form 33 whereby from inspection it will be evident that the wave forms have a sufficient difference in frequency to ensure coincidence of arrival of the waves of airborne vibrations at the surface of workpiece 24 substantially during the transition 32 from one state to another of the electrostatic charge on workpiece 24.

Figure 3:
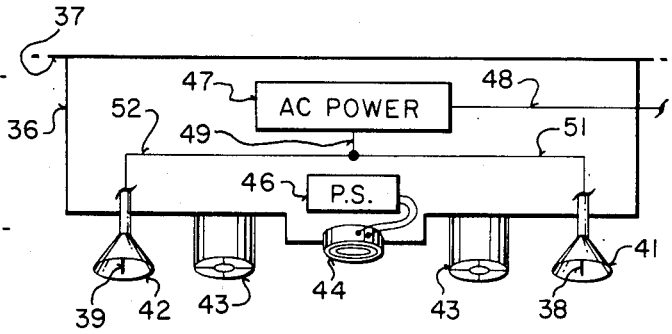
FIG. 3 shows a diagrammatic view of another embodiment of the invention.

According to another embodiment as shown in FIG. 3, a housing 36 secured to a support 37 carries ion discharge probes 38, 39 protected by conical shields 41, 42. Blowers 43 provide a downwardly directed flow of clean air as described above.

Housing 36 carries means for generating waves of sonic or ultrasonic vibrations to be projected downwardly from beneath housing 36. Accordingly, an ultrasonic generator 44 coupled to an associated power supply 46 provides suitable downwardly directed ultrasonic waves.

An AC power supply 47 connected by a lead 48 to an appropriate power source drives probes 38, 39 in phase with each other. Accordingly, the output lead 49 from power supply 47 connects to a pair of leads 51, 52 respectively coupled to probes 38, 39.

As described above, means for ionizing gases provides a substantially neutral charge on the surface of a semiconductor wafer represented by workpiece 24 shown in FIG. 1 so as to permit airborne vibrations from an ultrasonic or sonic source such as the ultrasonic generators 28, 44 to transmit vibrations at a rate causing them to strike the surface of the wafer when the surface has substantially the least attraction for the specks.

Figure 4:
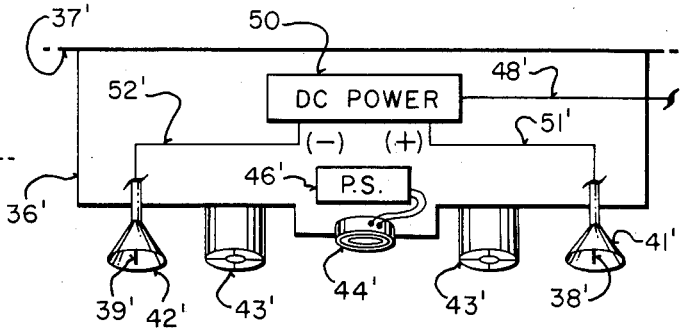
FIG. 4 shows a diagrammatic view of another embodiment of the invention.
Figure 5:
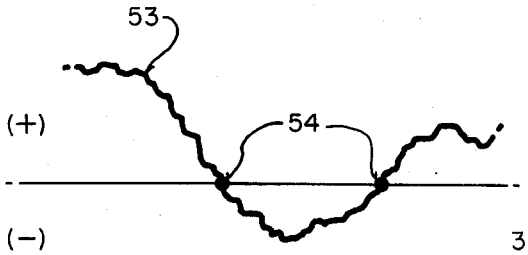
FIG. 5 shows a diagrammatic waveform representation for purposes of explanation of the embodiment of FIG. 4.

Another embodiment of the invention, as shown in FIG. 4, includes many of the system components described above with respect to the embodiment of FIG. 3. These components carry the same reference numerals as in FIG. 3 but with the addition of a prime mark (')added thereto.

However, in FIG. 4, a DC power supply 50 coupled to a power source via lead 48' simultaneously supplies a steady state positive voltage to probe 38' via lead 51' and a steady state negative voltage to probe 39' via lead 52'. It has been observed that by jointly generating positive and negative ions uninterruptedly from probes 38', 39', air discharged from blowers 43' will cause random changes in the charge on workpiece 24.

Thus, an erratic waveform 53 represents the static charge on workpiece 24. Even though waveform 53 may be erratic due to variances caused by the air from blowers 43', transitions 54 between a positive and negative charge will occur.

Impacting specks with air-borne vibrations at these transition points serves to most effectively remove submicron size specks from a surface.

From the foregoing it will be readily evident that there has been provided an improved cleaning system for removing extremely fine particles of matter from a surface of a type adapted to take on an electrostatic charge. By providing gas-borne vibrations directed toward the workpiece, any laminar flow of air which may be protecting extremely fine specks of contaminating matter on the surface will be penetrated to permit the specks to become entrained and carried from the surface. Release of the specks from the surface is made easier by insuring that the vibrations strike the surface when the charge thereon has been substantially neutralized.

I claim:

1. In a system for cleaning specks of contaminants from a static charged surface comprising means directing a stream of gas against the surface to blow the specks away, portions of said stream tending to provide a laminar flow of gas passing in protective spaced relation across said specks, means generating waves of positive and negative ions to flow toward said surface to charge said surface alternately positively or negatively to provide a substantially neutral charge thereto substantially during the transition between said positive and negative charges when said static charge acting on said specks is substantially at a minimum so as to tend to release the specks from the surface into said flow of gas, and means for disturbing said laminar flow to permit said specks to be entrained in and blown away from the surface by said stream of gas, the last-named means including means generating air-borne vibrations directed to flow toward the surface to disturb said laminar flow and specks during existence of said substantially minimum charge on said surface.

2. In a system for cleaning specks of contaminants from a static charged surface comprising means for generating positive and negative ions to flow toward the surface in a manner serving to charge said surface positively and negatively while providing a neutral charge at the transition therebetween, and means serving to generate waves of gas-borne vibrations directed toward said surface to dislodge said specks from said surface when said surface has substantially the least attraction for said specks.

3. A system for cleaning specks of contaminants from a static charged surface according to claim 2 in which the first named said means alternately generates said positive and negative ions at a first frequency, said second named means generates said waves at a second frequency, said second frequency being substantially different from said first frequency so as to ensure that said waves of gas-borne vibrations will act upon said specks when the surface has a substantially neutralized charge acting to retain said specks.

4. A system according to claim 2 wherein the first named said means and the second named said means generate positive and negative ions and said waves of gas borne vibrations at sufficiently different frequencies to ensure coincidence of arrival of said waves of vibrations at said surface substantially during said transition.

5. In a system for cleaning specks of contaminants from a static charged surface comprising means for alternately charging the surface positively and negatively to substantially neutralize the charge on said surface at the transistion between the positive and negative charge thereon so as to minimize the attraction of specks of matter for said surface, and means serving to generate waves of gas-borne vibrations directed to strike said surface coincident with the existence of said substantially neutral charge of said surface to dislodge said specks from said surface.

6. A system for cleaning specks of contaminants from a static charged surface according to claim 2 in which the first named said means generates a steady flow of both positive and negative ions, and means forming a stream of gas directed toward the surface to cause said ions to provide a varying static charge thereon including transitions between positive and negative.

* * * * *